United States Patent [19]

Vlnaty et al.

[11] 3,985,543

[45] Oct. 12, 1976

[54] METHOD FOR CARBONIZING AND DESULFURIZING CARBON

[75] Inventors: Joseph Vlnaty, Aliquippa; George A. Snyder, Bradford Woods; John A. Anthes, Rosslyn Farms, all of Pa.

[73] Assignee: Dravo Corporation, Pittsburgh, Pa.

[22] Filed: Jan. 8, 1975

[21] Appl. No.: 539,522

Related U.S. Application Data

[63] Continuation of Ser. No. 240,399, April 4, 1972, abandoned.

[52] U.S. Cl. ..... 75/3; 75/6

[51] Int. Cl.[2] ..... C22B 1/08

[58] Field of Search ..... 75/3, 6

[56] References Cited

UNITED STATES PATENTS

| | | | |
|---|---|---|---|
| 2,495,225 | 1/1950 | Buehl | 75/6 |
| 3,210,180 | 10/1965 | Jukkola | 75/26 |

*Primary Examiner*—Peter D. Rosenberg

*Attorney, Agent, or Firm*—Parmelee, Miller, Welsh & Kratz

[57] ABSTRACT

In the continuous carbonizing and desulfurizing of formcoke produced from coal of relatively high sulfur content, a shaft type reactor receives both formed green compacts and a particulate sulfur acceptor at the top and these descend together through definite preheating, calcining and cooling zones. Highly heated non-oxidizing hydrogen-containing gas is introduced into the reactor at the level between the calcining and cooling zones to flow upward through the reactor and provide the principal, if not the only source of heat for the reactor. At an intermediate level between the calcining zone and preheating zone, a portion of the rising current of gas, comprising both original gas and additional evolved gases is withdrawn from the reactor and part of the gases so withdrawn is burned in a heat exchanger to heat another part to the high temperature required to thus provide the highly-heated hydrogen-containing gas that is introduced into the reactor as described. Gases not withdrawn at the intermediate level carry heat up through the preheating zone, and with evolved gases are removed at the top of the reactor.

9 Claims, 2 Drawing Figures

FORMCOKE COMPACTS
SOLID SULFUR ACCEPTOR
PREHEATING ZONE
OFF GAS
PRODUCT GAS
CALCINING ZONE
PORTION OF HOT GASES
GAS HEATER
HOT NON-OXIDIZING GAS
COOLING ZONE
SEPARATOR
CALCINED DE-SULFURIZED COKE PRODUCTS
SOLID SULFUR ACCEPTOR

GAS CLEANING
PRODUCT GAS
AIR
10
11
12
13
14
15
16
17
18
19
20
21
22
23
24
25
26
27
28
29
30
31
32
33
34
35
36
37
38
39
40
41
42

METHOD FOR CARBONIZING AND DESULFURIZING CARBON

This application is a continuation of our application Ser. No. 240,399 filed Apr. 4, 1972, now abandoned, which, so far as it may be relevant, is incorporated herein by reference, and is for an improvement in U.S. Pat. No. 3,753,683 granted on the application of Joseph Vlnaty, one of the co-inventors herein and assigned to the same assignee as this application.

Said U.S. Pat. No. 3,753,683, like the present application, is for a method of an apparatus for carbonizing and desulfurizing coal-iron compacts to render them especially useful in the stock column of a blast furnace or other metallurgical process. As therein disclosed, compacts are prepared from finely-divided high sulfur content coal, typically containing in excess of 1% sulfur, and iron particles comprising iron and/or iron oxide. These compacts are discharged into the top of a vertical shaft furnace type of reactor where they travel downwardly to be eventually enveloped in highly-heated particulate material and thereafter the mass of combined particulate material and enveloped compacts descend through the shaft furnace against a current of upflowing non-oxidizing hydrogen-containing gas. The particulate material may comprise a sulfur acceptor which will combine with the hydrogen-sulfide that results by the reaction of the hydrogen with the sulfur in the coal while carbonizing the coal along with reduction of at least some iron oxide, where the oxide is used in the compacts, resulting in a substantial hardening of the compacts. At the bottom of the shaft furnace the compacts and particulate material are discharged and separated. Hydrogen and other gases are removed from the top of the furnace, volatiles and certain impurities are removed therefrom, and part of this hydrogen-containing gas is recycled directly to the shaft furnace to provide the aforesaid countercurrent flow of hydrogen-containing gas. Since the reactions in the shaft furnace are endothermic and because of other heat losses, the heat particulate material will decrease in temperature toward the bottom of the furnace and when the particulate material leaves the bottom of the furnace it will be much cooler than when it was introduced at the top. Therefore it must be heated for return to the furnace so that it is returned through an airlift type of furnace where fuel supplied by some of the off-gases from the reactor burned with air heats the particulate material while raising it to a level where it can be returned to the furnace near the top but below the input level of the compacts. In this lifting and reheating of the particulate material in an oxidizing atmosphere in the airlift furnace the sulfur in the particulate material, if it is a sulfur acceptor is oxidized, and the resulting $SO_2$ gas is discharged from the system.

As disclosed in said patent, part of the hydrogen-bearing gas that is recirculated to the shaft furnace may be selectively passed through the cooled solid particulate material to recuperate some of the remaining heat, and this gas is then mixed with the remaining stream of recycled gas flowing into the reactor. Even if all of the recycle gas were circulated through this discharged mass of particulate material, its temperature would be below the temperature at the top of the furnace where the hot particulate material is discharged into the shaft and contacted with the relatively cold compacts.

SUMMARY OF THE PRESENT INVENTION

The temperature to which the compacts were subjected in the process and apparatus disclosed in the Vlnaty U.S. Pat. No. 3,753,683 was in the range of 1200° to 1800°F., whereas calcining the compacts at a higher temperature results in an improved product. This invention provides an economical procedure and apparatus wherein the compacts are not only calcined at a higher temperature but, instead of encountering the highest temperature where they contact the incoming hot particulate material, move downwardly in a continuous progression in the reactor toward a level of increasing temperature first through a preheating zone and then into a calcining zone, thereafter entering a cooling and exit zone with the maximum temperature being reached just in advance of the cooling and exit zone, essentially reversing the temperature gradient from that prevailing, at least for the most part, in said earlier patent.

This is accomplished by heating the hydrogen-containing gas which is recirculated to the reactor to a high temperature heat exchanger and then introducing it at high temperature developed in the heat exchanger into the lower portion of the reactor just ahead of a cooling zone. Since this highly-heated gas travels countercurrent to the descending compacts and surrounding particulate sulfur acceptor the compacts encounter increasingly higher temperatures as they travel toward the level of the heated gas inlet where temperatures ranging in the general level between 1800° and 2200° F. are encountered.

The particulate material which is also the sulfur acceptor, though it may be subjected to a heated oxidizing atmosphere to remove the sulfur, is not recycled to the top of the reactor as it is in said patent, to provide the principal heat supply to the reactor, but, as indicated above, the main source of heat is provided by the hot, recycled hydrogen-containing gas. Instead of the gas being burned to heat particulate material that is then discharged into the top of the reactor, the present invention desirably burns some of the off-gases to heat a bed of material that does not enter the reactor, but which comprises a heat exchange medium for heating to a high temperature the portion of the hydrogen-bearing off-gases that are recycled to the reactor.

In the present invention some of the off-gases are withdrawn from the reactor intermediate the top and level where the highly-heated hydrogen-containing gas is introduced, resulting in dividing the interior of the reactor above the cooling zone into a well-defined preheating zone through which only a portion of the hydrogen-containing non-oxidizing gas flows countercurrent to the compacts and particulate sulfur acceptor material and a calcining zone below the preheating zone and above the cooling zone through which all of the highly-heated hot hydrogen-containing non-oxidizing gas travels and becomes mixed with off-gases generated in the calcining zone. The gases so removed from the intermediate level between the preheating zone and calcining zone after removal from the reactor pass through a cooler to partially reduce the temperature of the gas and the resulting gas stream is then separated into at least two channels or streams. One stream is used to fire a heat exchanger to a high temperature while the other stream is directed through the heat exchanger to be highly heated, as above described, and then discharged directly into the bottom of the calcining zone. The heat exchanger is preferably a falling bed heater where high temperature can be developed by intimate direct contact of the gas to be heated with incandescent particulate material heated in an atmosphere of burning gases and then circulated through a heat exchange chamber through which the gas to be heated circulates.

Gas not removed at the intermediate level and other gases evolved in the preheating zone are removed from the top of the preheating zone but these, which are more contaminated than the gas withdrawn at the intermediate level and recycled are disposed of separately from the gas streams which are burned or recycled to the reactor, in contrast to the process and apparatus of said U.S. Pat. No. 3,753,683.

DESCRIPTION OF THE PREFERRED EMBODIMENTS

Figures 1, 2:
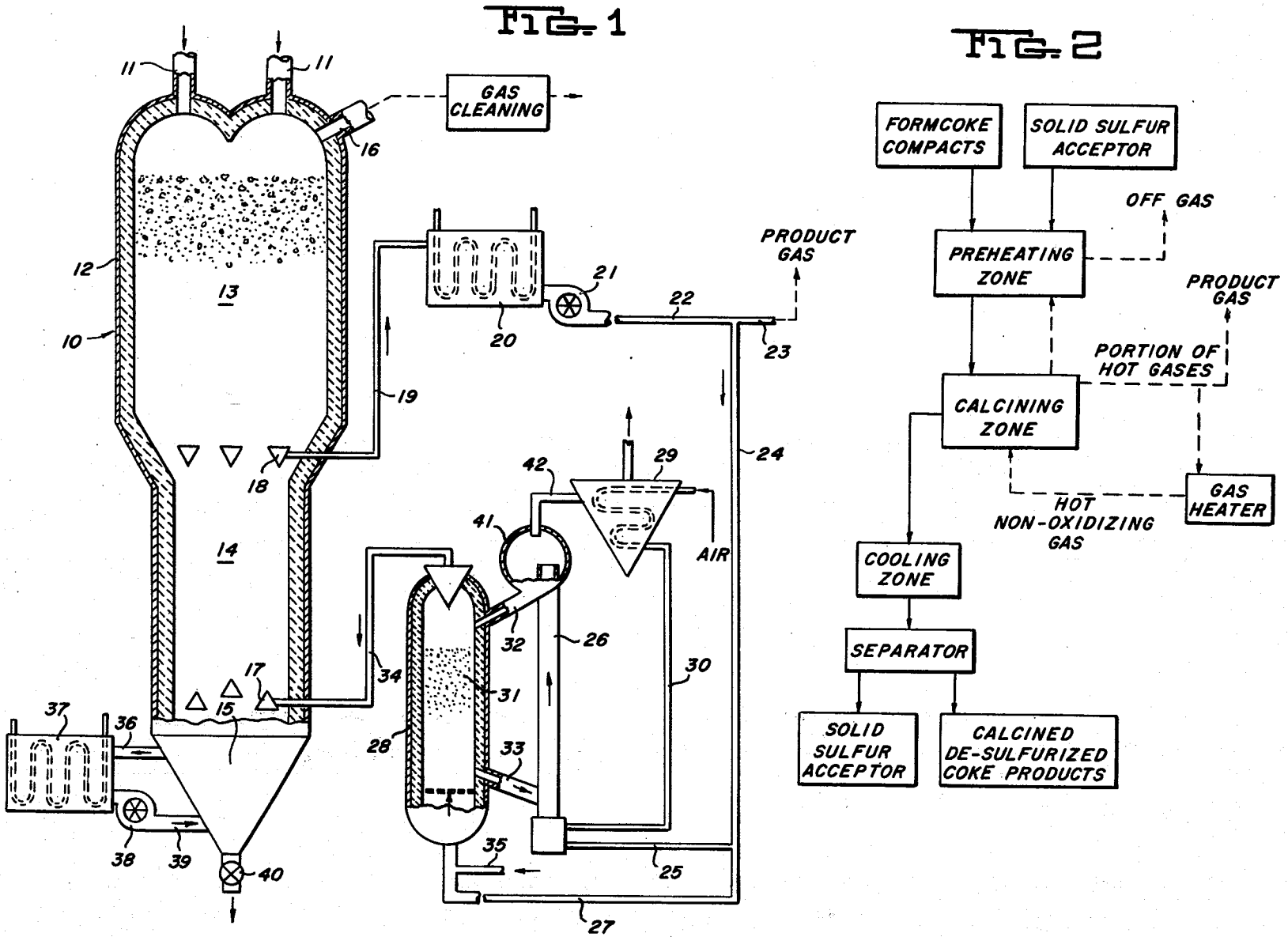
FIG. 1 is a schematic drawing of the apparatus of the present invention.
FIG. 2 is a schematic flow diagram of the method of the present invention.

The invention can be best understood by reference to the exemplary embodiment of the apparatus seen in FIG. 1, and by reference to the process flow diagram of FIG. 2. In FIG. 1 a reactor comprising a countercurrent shaft furnace 10 is illustrated which has inlets 11 at the top through which formcoke compacts, as described for example in said U.S. Pat. No. 3,753,683, and a particulate or finely-divided solid sulfur acceptor, which also may be a substance disclosed in said patent, are continuously charged into the furnace. The furnace 10 is a vertical countercurrent gas flow furnace which comprises a refractory-lined shaft 12 which has a plurality of internally-defined furnace zones, including a preheating zone 13 at the uppermost portion of the furnace 10, a calcination zone 14 below the preheating zone, and finally a cooling zone 15 at the bottom of the shaft below the calcination zone. The formcoke and solid sulfur acceptor are mixed and pass through the preheating zone 13 under the action of gravity. The temperature of the formcoke in the preheating zone, generated as hereinafter described, varies from about 1500°F. at the bottom portion to about 800°F. at the topmost portion. Gas evolved from the preheating operation, as well as gas flowing upward from the calcining zone, exits the furnace at outlet 16 which leads to a conventional separating and washing apparatus, not shown. A degree of desulfurization of the carbon formcoke product is effected in the preheating zone and any moisture and low temperature gases and volatiles are removed in the preheating process. Since the compacts and acceptor enter the furnace together and become heated together, no condition exists where the hottest gas flow in the furnace first contacts the incoming compacts before the compacts are mixed with the sulfur acceptor.

The formcoke starting material is an agglomerate which has been compacted by conventional processing to compacts which are typically about ¾ of an inch to 2 or 3 inches in average diameter. The formcoke starting material has also been preferably partially devolatilized by heat treatment before admission to the furnace 10.

As finished formcoke product and the solid particulate acceptor are removed from the bottom of the shaft, the preheated mixture of compacts and sulfur acceptor descends by gravity through the preheating zone, and then enters the calcination zone 14. In the calcination zone the admixed material is intimately contacted with a countercurrently-moving stream of highly heated non-oxidizing, hydrogen-containing gas which is admitted to the furnace through gas inlet means 17. There is a gas withdrawal means 18 at about the topmost portion of the calcination zone through which a portion of the gas leaving the top of zone 14 is removed from the furnace. The portion of gas not so withdrawn at this intermediate level between the two zones flows upwardly into and through the preheating zone, carrying the required heat into the preheating zone.

The gas which is withdrawn through gas outlet means 18 is passed through conduit 19 to a cooler 20 where it is cooled to the extent necessary to avoid damage to motive means 21 into conduit 22 and combustible excess gas may, when desired, be withdrawn through conduit 23. A portion of the combustible reusable gases are passed through conduits 24 and 25 to a heat exchanger. The heat exchanger preferably is one which has a gas-lift combustion chamber 26. A second or remaining portion of the combustible reusable gas flows through conduit 27 into that part of a heat exchanger 28 which preferably is constructed to receive highly-heated particulate material that has been heated in the gas lift combustion chamber 25 and characterized as a fluid bed or falling bed heater. Spent gases from gas lift chamber 26 is circulated through a second heat exchanger 29 used to preheat air which is supplied through conduit 30 to gas lift combustion chamber 26 where it is used to burn the gas supplied through conduits 24 and 25.

The solid particulate material 31 which is intensely heated in the airlift combustion chamber is transferred through passage 32 directly to chamber 28 and from the bottom of this chamber is circulated back to the combustion chamber through passage 33, while the spent combustion gases are separated from the circulating solid heat exchange material, for example, by separator means 41, with the solid heat carrier 31 being conducted into conduit 32 and the combustion products exiting via conduit 42 which is connected to heat exchanger 29 so that these products of combustion can be used to preheat the air entering in conduit 30 as above described. The heated solids 31 are carried upward in the gas lift 26, heated, and pass into the fluid bed heater 28 through conduit 32 which connects fluid bed heater 28 to the separator means 41. The solid heat exchange means 31 is cooled through contact with the upwardly-flowing gases in fluid bed heater 28 and circulated through conduit 33 at the lowermost portion of the fluid bed heater 28, back to the gas lift combustion chamber 26. That portion of the recycled gas directed through conduit 27 enters the fluid bed heater 28 at one end and is heated in passing upwardly through the hot particulate material to a temperature greater than about 1800°F. and even greater than about 2200°F. This highly-heated calcining gas, which is non-oxidizing hydrogen-containing gas with a hydrogen content which can be widely varied but is for example, about 50% by volume or greater, exits fluid means heater 28 via conduit 34 which carries it with minimum heat loss to gas inlet means 17, above described, at the bottom of the calcining zone. The remainder of the calcining gas principally comprises various gaseous hydrocarbons.

Small quantities of carbon dioxide or water vapor can be admitted, if desired, via conduit 35 and admixed with the recycled product gases in conduit 27 prior to its contact with the hot particulate material 28. These gases will react to form carbon monoxide and/or hydrogen by reaction with any elemental carbon present or methane present in the recycle gas. The purpose of this practice is to prevent excessive coating of the solid heat carrier with carbon produced by cracking of hydrocarbons in the recycled gas. The calcining gas is preferably at a temperature sufficient to heat the formcoke material to about 1800° to 2200°F., and intimately contacts the formcoke and the solid sulfur acceptor within calcination zone 14 to complete desulfurization of the product while effecting graphitization and hardening of the formcoke to produce a low reactivity, low volatility coke product.

The cooling zone 15 has a gas inlet conduit 39 which permits cycling of the non-oxidizing relatively cooler gas present therein via outlet conduits 36 and a heat exchanger 37, and return via motive means 38 and conduit 39 to the cooling zone. Some of the cooling gas, which is non-oxidizing, may be allowed to flow upward into the calcining zone if desired. The calcined coke product and spent sulfur acceptor exit the furnace at outlet 40, and the solid sulfur acceptor which is thereafter separated from the coke product by conventional means can be regenerated by means well known in the art to allow for its reuse.

The formcoke starting material can comprise compacts of partially devolatilized coal or a mixture of such coal and tar or pitch as a binder, which formcoke product is preferably compacted into briquettes or pellets. The sulfur acceptor is in a finely-divided state and can be elemental iron, dolomite, magnesium oxide or other such well-known sulfur acceptors. With the present invention all, or at least a major part of the heat supplied to the reactor is carried into the shaft by the recycled hot gas introduced at 17 so that the sulfur acceptor is not the principal heat carrier, if it is a heat carrier at all, thereby affording the greater flexibility in the selection of the acceptor, than is permitted, for example by the disclosure of said U.S. Pat. No. 3,753,683.

The solid heat carrier utilized in the heat exchanger in the present invention but not cycled into the reactor, can be a granulated, refractory material, and by way of example, silica, alumina, magnesium oxide or the like can be used.

In practicing the process of the present invention the starting formcoke compacts can comprise a variety of carbonaceous mixtures. The calcining of these compacts results in volatilization of substantial amounts of gas which comprises about 50% hydrogen gas. This hydrogen-containing volatilized gas is recycled and provides both the heat carrier to effect calcining of the compacts, as well as providing hydrogen for desulfurizing the compacts.

The formcoke compacts can be admixed with the solid sulfur acceptor prior to admission of same into inlets 11, or can be admixed upon admission.

The amount of solid sulfur acceptor will, of course, depend upon the particular acceptor used, by way of example, when finely-divided iron is utilized, the iron is preferably admixed in an amount of about 5 to 10 weight percent of the total mixture of acceptor and compact. The finely-divided iron sulfur acceptor has an average particle size of about minus 20 mesh size.

The present method is a very efficient process in which the sustaining combustible fuel and hydrogen required are evolved principally or entirely from the formcoke material itself, once the reaction has been started. The exhaust gas which is passed through exit 16, after solid separation and washing, can be used in the cooling zone to insure a low dust content gas in this zone.

The resultant metallurgical formcoke product which is had from use of the apparatus and method of the present invention has an increased strength and the sulfur content has been reduced to acceptable levels for use in steelmaking processes.

The resultant desulfurized and carbonized formcoke product is less reactive with carbon dioxide and water vapor present in a blast furnace stock column than formcoke prepared by prior processes of which we are aware. This means that the coke product will not be wasted by such reaction but will be efficiently utilized in the metallurgical processing of the ore in the blast furnace. This lower reactivity is attributable to the fact that the method and apparatus of the present invention provides for a carbonizing and desulfurizing of the formcoke compacts at a higher temperature, that is between about 1800° and 2200°F.

It should be understood that the solid sulfur acceptor and the compacts may be introduced into the top of the reactor as a previously prepared mixture, or may be separately introduced through the same or different charging openings in the top of the reactor so as to mix together as they descend through the shaft.

We claim:

1. The continuous process of desulfurizing and carbonizing formcoke compacts in a reactor through which the compacts together with a finely divided sulfur acceptor pass wherein:

a. the reactor is a vertical shaft furnace having an uppermost preheat zone and a lowermost exit zone and the compacts and a finely-divided sulfur acceptor move downwardly together from a common first place of introduction of the compacts and sulfur acceptor in the said preheat zone in a continuous progression toward a place immediately ahead of said exit zone where highly-heated hydrogen-containing non-oxidizing gas is continuously supplied to the reactor to heat the interior thereof with the compacts and sulfur acceptor moving counter-current to the hot gas through a continuously-increasing temperature gradient from said preheat zone toward the place where the highly-heated hydrogen gas enters the reactor and thereafter enter the exit zone, b. withdrawing a portion of the gases moving through the reactor at a level intermediate the preheat zone and the place of introduction of the highly-heated hydrogen-containing gas, c. burning a portion of the gas so removed in a heat exchanger in which the heat of the gas so burned is used to heat the other portion of the gas so withdrawn, and utilizing the gas so heated to provide the said highly heated gas which is introduced into the reactor, d. circulating that portion of the gases moving upwardly through the reactor which is not so removed at said intermediate level through the mixture of compacts and sulfur acceptor in the preheat zone to initially heat said mixture and thereafter removing said portion of the gases from the preheat zone; and e. removing the compacts and solid sulfur acceptor from the reactor through the exit zone at the lowermost end of the reactor.

2. The process defined in claim 1 wherein the burning of the gas in the heat exchanger heats solid particles to incandescence in a first environment whereupon said heated particles are transferred into a second environment separate from the one in which they are heated and which is removed from the burning gases and through which said other portion of the gas flows to become heated by contact with said particles and the particles after yielding heat to the said other portion of the gas are returned to that portion of the heat exchanger in which they are heated and so continuously recycled.

3. The process defined in claim 1 in which the compacts and sulfur acceptor are at least partially cooled after they have entered the exit zone and before they are discharged from the reactor.

4. The process defined in claim 3 wherein gases discharged from the preheat zone are cooled and cleaned and circulated through the compacts and sulfur acceptor in the exit zone to accelerate cooling.

5. In the process of desulfurizing and calcining carbonaceous formcoke compacts wherein the formcoke compacts are calcined at a temperature of between 1800° and 2200°F. in a furnace in the presence of finely-divided solid sulfur acceptor and highly-heated hydrogen-containing non-oxidizing gas, the improvement comprising:

a. introducing the compacts and finely-divided sulfur acceptor into a furnace having in succession a preheating zone, a calcining zone and a cooling zone, b. continuously progressing the material so charged comprising the combined compacts and finely-divided sulfur acceptor so charged into the furnace successively through the preheating zone and then the calcining zone with the material traveling countercurrent to a flow of highly-heated hydrogen-containing non-oxidizing gas, and from the calcining zone the material is then progressed through the cooling zone from whence it is discharged, c. introducing the heated hydrogen-containing non-oxidizing gas into the calcining zone of the furnace in advance of the cooling zone at a temperature where the compacts and sulfur acceptor are heated in the range between about 1800° and 2200°F. before they are transferred to the cooling zone, d. removing a portion of the gas so produced together with additional gas generated in the calcining zone from the area of the furnace between the preheating zone and the calcining zone, e. passing the remaining portion of the gas through the preheating zone to preheat the compacts and sulfur acceptor, and to effect removal of low temperature volatiles and any contained moisture therefrom and effect the sequestering of at least some of the sulfur by the acceptor and discharging such portion of the gas from the furnace after it has passed through the preheating zone, f. dividing the stream of gas first removed from the furnace in the area between the calcining zone and the preheating zone into two streams and burning the gas in one said stream and indirectly transferring the heat produced thereby to the other portion of said stream while avoiding the transfer of combustion gases to said other stream to thereby provide a stream of highly-heated hydrogen-containing non-oxidizing gas, and g. discharging the hydrogen-containing non-oxidizing gas that has been thus highly heated into the calcining zone of the furnace to provide in conjunction with gas evolved in the calcining zone the aforesaid countercurrent flow of heated gas through the calcining and preheating zones.

6. The process defined in claim 5 wherein the transfer of heat from the burning of one of said streams of gas is effected by contacting a continuous stream of inert heat carrier particles with the burning gas in one environment whereby said particles become intensely heated and then continuously transferring said stream of hot carrier particles into a second environment separated from the first and from the products of combustion in which said second stream of gas circulates to thereby become highly heated.

7. The process specified in claim 5, wherein the calcined compacts are cooled and separated from the solid sulfur acceptor after discharge from said cooling zone of the furnace.

8. The process defined in claim 5, wherein condensable products are removed from the evolved gas which is removed from the furnace before a portion of the gas is burned and used to heat the other portion of the gas.

9. The process defined in claim 6, wherein gases which are reactive with carbon may be admixed with the remainder portion of the withdrawn stream of gas before said admixed gas is intimately contacted by the solid heat carrier to effect removal of carbon deposits on said solid heat carrier.

* * * * *